US007922297B2

(12) United States Patent
Guan et al.

(10) Patent No.: US 7,922,297 B2
(45) Date of Patent: Apr. 12, 2011

(54) INK EJECTION DEVICE INCLUDING A SILICON CHIP HAVING A HEATER STACK POSITIONED OVER A CORRESPONDING POWER TRANSISTOR

(75) Inventors: Yimin Guan, Lexington, KY (US); Kristi Maggard Rowe, Richmond, KY (US); Timothy Lowell Strunk, Georgetown, KY (US); Carl Edmond Sullivan, Stamping Ground, KY (US)

(73) Assignee: Lexmark International, Inc., Lexington, KY (US)

( * ) Notice: Subject to any disclaimer, the term of this patent is extended or adjusted under 35 U.S.C. 154(b) by 577 days.

(21) Appl. No.: 11/958,876

(22) Filed: Dec. 18, 2007

(65) Prior Publication Data

US 2009/0153622 A1 Jun. 18, 2009

(51) Int. Cl.
*B41J 2/05* (2006.01)

(52) U.S. Cl. ..... 347/59

(58) Field of Classification Search ..... 347/57, 347/59
See application file for complete search history.

(56) References Cited

U.S. PATENT DOCUMENTS

2005/0168534 A1* 8/2005 Beak ..... 347/59

OTHER PUBLICATIONS

IC Knowledg Glossary-F and Semiconductor One Source_Semiconductor Glossary—Search for_bpsg.*

* cited by examiner

*Primary Examiner* — Matthew Luu
*Assistant Examiner* — Lisa M Solomon

(57) ABSTRACT

A silicon chip has a plurality of ink jetting structures. Each ink jetting structure of the plurality of ink jetting structures includes a heater stack having an electrical heater element. A power transistor is electrically connected to the electrical heater element. A planarization layer is interposed between the power transistor and the heater stack. The planarization layer has a planar base surface on which the heater stack is formed.

14 Claims, 4 Drawing Sheets

INK EJECTION DEVICE INCLUDING A SILICON CHIP HAVING A HEATER STACK POSITIONED OVER A CORRESPONDING POWER TRANSISTOR

BACKGROUND OF THE INVENTION

1. Field of the Invention

The present invention relates to an ink ejection device, and, more particularly, to an ink ejection device including a silicon chip having a heater stack positioned over a corresponding power transistor.

2. Description of the Related Art

Typical ink ejection devices, e.g., ink jet printheads, include a chip layout wherein ejection heaters and their respective power transistors are located side by side. In a conventional design, for example, the ejection heater element and the field effect transistor (FET) for a given nozzle are arranged end-to-end so that each one's width adds to the overall width of the chip. This arrangement limits the number of chip dies which may be harvested from a silicon wafer. By reducing the width of the chip, the effective yield of a silicon wafer may be increased.

SUMMARY OF THE INVENTION

The present invention provides a silicon chip for use in an ink ejection device having a configuration that permits an increase in the effective yield of a silicon wafer.

The terms "first" and "second" preceding an element name, e.g., first heater stack, second heater stack, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

The invention, in one form thereof, is directed to a silicon chip having a plurality of ink jetting structures. Each inkjetting structure of the plurality of inkjetting structures includes a heater stack having an electrical heater element. A power transistor is electrically connected to the electrical heater element. A planarization layer is interposed between the power transistor and the heater stack. The planarization layer has a planar base surface on which the heater stack is formed.

The invention, in another form thereof, is directed to an ink ejection device. The ink ejection device includes a nozzle plate having a plurality of nozzle holes. A silicon chip has a plurality of ink jetting structures respectively associated with the plurality of nozzle holes. Each ink jetting structure of the plurality of ink jetting structures includes a heater stack and a power transistor. The heater stack has an electrical heater element. The power transistor is electrically connected to the electrical heater element. A planarization layer is interposed between the power transistor and the heater stack. The planarization layer has a planar base surface on which the heater stack is formed.

The invention, in another form thereof, is directed to a method for fabricating a silicon chip for use in an ink ejection device. The method includes forming a plurality of power transistors on a die of semiconductor material; forming a planarization layer over the plurality of power transistors; smoothing the planarization layer to form a planar base surface; and forming a plurality of heater stacks on the planar base surface, with each heater stack of the plurality of heater stacks being positioned directly over and electrically connected to a respective power transistor of the plurality of power transistors.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, in one form, and such exemplifications are not to be construed as limiting the scope of the invention in any manner.

DETAILED DESCRIPTION OF THE INVENTION

Figure 1:
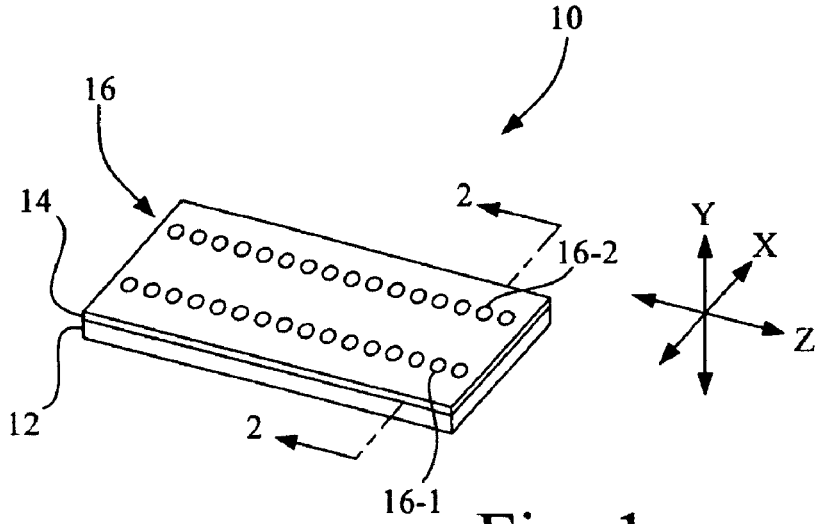
FIG. 1 is a diagrammatic depiction in perspective view of an ink ejection device configured in accordance with an embodiment of the present invention.

Referring now to the drawings and particularly to FIG. 1, there is shown an ink ejection device 10, sometimes referred to as an ink jet printhead. For convenience and ease of discussion, ink ejection device 10 as shown in FIG. 1 is oriented with respect to an X-axis, a Y-axis, and a Z-axis, with each axis being perpendicular to the other two axes. As used herein, the term Y-plane is a plane oriented parallel to the Y-axis, and the term X, Z-plane is a plane parallel to the X and Z axes that is perpendicular to the Y-plane.

Ink ejection device 10 includes a silicon chip 12 and a nozzle plate 14. A major elongation of silicon chip 12 lies along an X, Z-plane, and Y-planes perpendicularly intersect the X, Z-plane along a thickness of silicon chip 12. Nozzle plate 14 is attached to, or alternatively formed on, silicon chip 12.

Nozzle plate 14 may be formed, for example, from a plastic, silicon, or metal material. Nozzle plate 14 includes a plurality of nozzle holes 16, with two exemplary nozzle holes identified as nozzle holes 16-1 and 16-2. In the present example, thirty-two nozzles are arranged in two columns of sixteen nozzle holes each, but it is to be understood that the actual number of the plurality of nozzle holes 16 may be in the hundreds or thousands per nozzle plate, and may be arranged in one or more columns, as desired.

Figure 2:
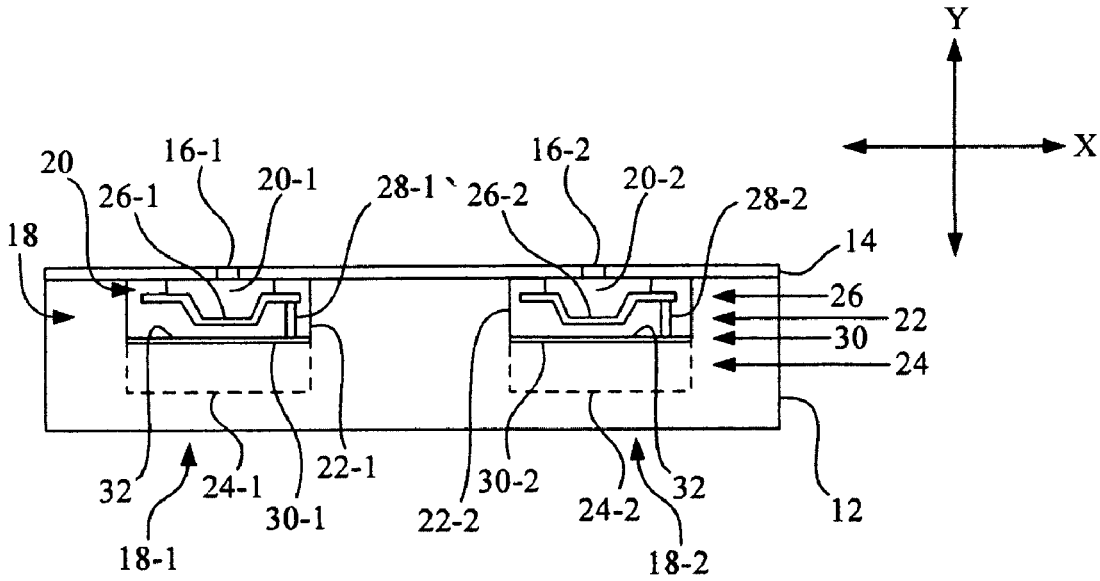
FIG. 2 is a schematic Y section view of the ink ejection device of FIG. 1 taken along a Y-plane through line 2-2 of FIG. 1.

Referring to FIG. 2, there is shown a schematic Y section view of ink ejection device 10 taken along a Y-plane passing through line 2-2 of FIG. 1, intersecting nozzle holes 16-1 and 16-2. As shown in FIG. 2, for example, silicon chip 12 includes a plurality of ink jetting structures 18 respectively associated with the plurality of nozzle holes 16. As shown in FIG. 2, for example, associated with nozzle hole 16-1 is an inkjetting structure 18-1, and associated with nozzle hole 16-2 is an ink jetting structure 18-2.

The plurality of ink jetting structures 18 may include, for example, a corresponding plurality of ink ejection chambers 20, a corresponding plurality of heater stacks 22 and a corresponding plurality of power transistors 24. As a more specific example, ink jetting structure 18-1 may include an ink ejection chamber 20-1, a heater stack 22-1 and a power transistor 24-1, and inkjetting structure 18-2, for example, may include an ink ejection chamber 20-2, a heater stack 22-2 and a power transistor 24-2.

The plurality of ink ejection chambers 20 have associated therewith a plurality of electrical heater elements 26 formed as a part of respective heater stacks 22, and more particularly, each ink ejection chamber of the plurality of ink ejection chambers 20 has associated therewith at least one electrical heating element for heating ink in the respective ink ejection chamber. In the example shown in FIG. 2, for example, associated with ink ejection chamber 20-1 is an electrical heater element 26-1 formed as a part of a heater stack 22-1, and associated with ink ejection chamber 20-2 is an electrical heater element 26-2 formed as a part of a heater stack 22-2. Also, the plurality of power transistors 24 are individually electrically connected to respective electrical heater elements of the plurality of electrical heater elements 26 by conductor structures 28-1, 28-2, etc.

In accordance with an aspect of the present invention, the plurality of power transistors 24 and the respective plurality of electrical heater elements 26 are arranged in a stacked arrangement, such that a respective Y-plane passing through each electrical heater element and associated heater stack of the plurality of heater stacks 22 correspondingly passes through a respective power transistor of the plurality of power transistors 24. Each power transistor included on silicon chip 12 may be, for example, a complementary metal-oxide-semiconductor (CMOS) field effect transistor (FET).

During the fabrication of silicon chip 12, a planarization layer 30 is formed, and smoothed, over power transistors 24 to form a smooth planar base surface 32 over which respective heater stacks 22 are formed and electrical heater elements 26 are positioned. In other words, planarization layer 30 is interposed between each power transistor 24 and its corresponding heater stack 22. Planarization layer 30 may be formed, for example, from a spin-on-glass (SOG) material, a chemical vapor deposition/physical vapor deposition (PVD/CVD) silicon oxide (SiO2), or a low K dielectric material, such as aerogel, etc.

As shown in FIG. 2, positioned along the Y-plane through line 2-2 perpendicularly passing through electrical heater element 26-1 of heater stack 22-1 is power transistor 24-1, e.g., as shown power transistor 24-1 is positioned under electrical heater element 26-1 in a stacked arrangement. In order to construct this stacked structure of electrical heater element 26-1 of heater stack 22-1 and power transistor 24-1, a planarization layer portion 30-1 resulting from the smoothing (e.g., by polishing or back etching) of planarization layer 30 is formed over power transistor 24-1. Electrical heater element 26-1 is positioned over planarization layer portion 30-1 later in the process of forming heater stack 22-1. Power transistor 24-1 is electrically connected to electrical heater element 26-1 by way of conductor structure 28-1.

Also, as shown in FIG. 2, positioned along the Y-plane through line 2-2 perpendicularly passing through electrical heater element 26-2 of heater stack 22-2 is power transistor 24-2, e.g., as shown power transistor 24-2 is positioned under electrical heater element 26-2 in a stacked arrangement. In order to construct this stacked structure of electrical heater element 26-2 of heater stack 22-2 and power transistor 24-2, a planarization layer portion 30-2 resulting from the smoothing (e.g., by polishing or back etching) of planarization layer 30 is formed over power transistor 24-2. Electrical heater element 26-2 is positioned over planarization layer portion 30-2 later in the process of forming heater stack 22-2. Power transistor 24-2 is electrically connected to electrical heater element 26-2 by way of conductor structure 28-2.

Figure 3:
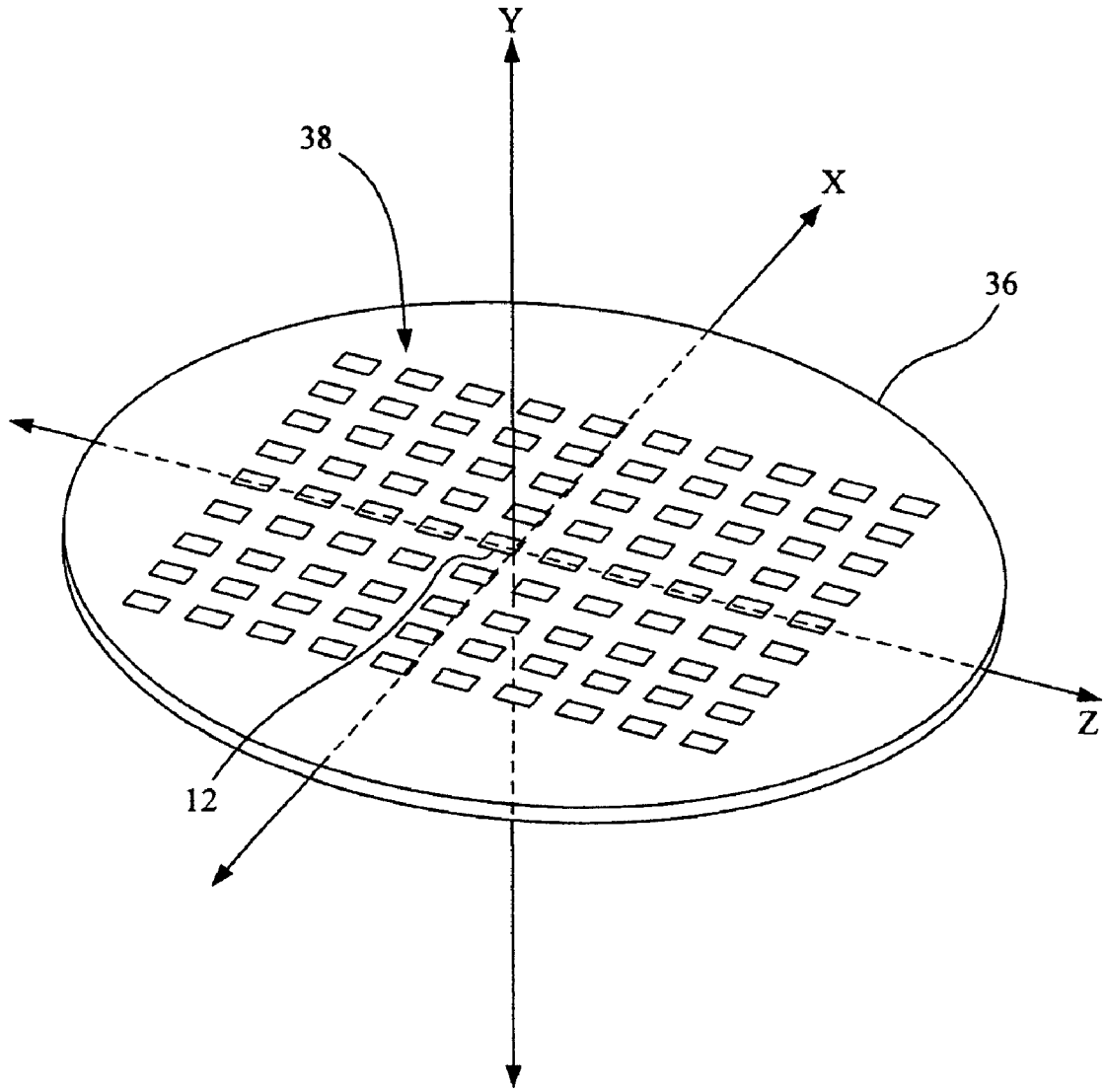
FIG. 3 is a diagrammatic depiction of a silicon wafer that includes a plurality of dies, from which the silicon chip of the ink ejection device of FIG. 1 may be harvested.

Referring to FIG. 3, there is shown a silicon wafer 36 of semiconductor material that includes a plurality of dies 38. Each die when separated from silicon wafer 36 forms a respective silicon chip 12. By positioning each of the power transistors under its respective electrical heater element in a stacked arrangement, as described above, a reduction in the planar area of each silicon chip 12 in the X, Z-plane is achieved over that of a non-stacked arrangement. As a result, the size (e.g., width parallel to the X-axis) of silicon chip 12 may be reduced, and in turn the number of dies 38 available in the X, Z-plane of silicon wafer 36 may be increased.

Figure 4:
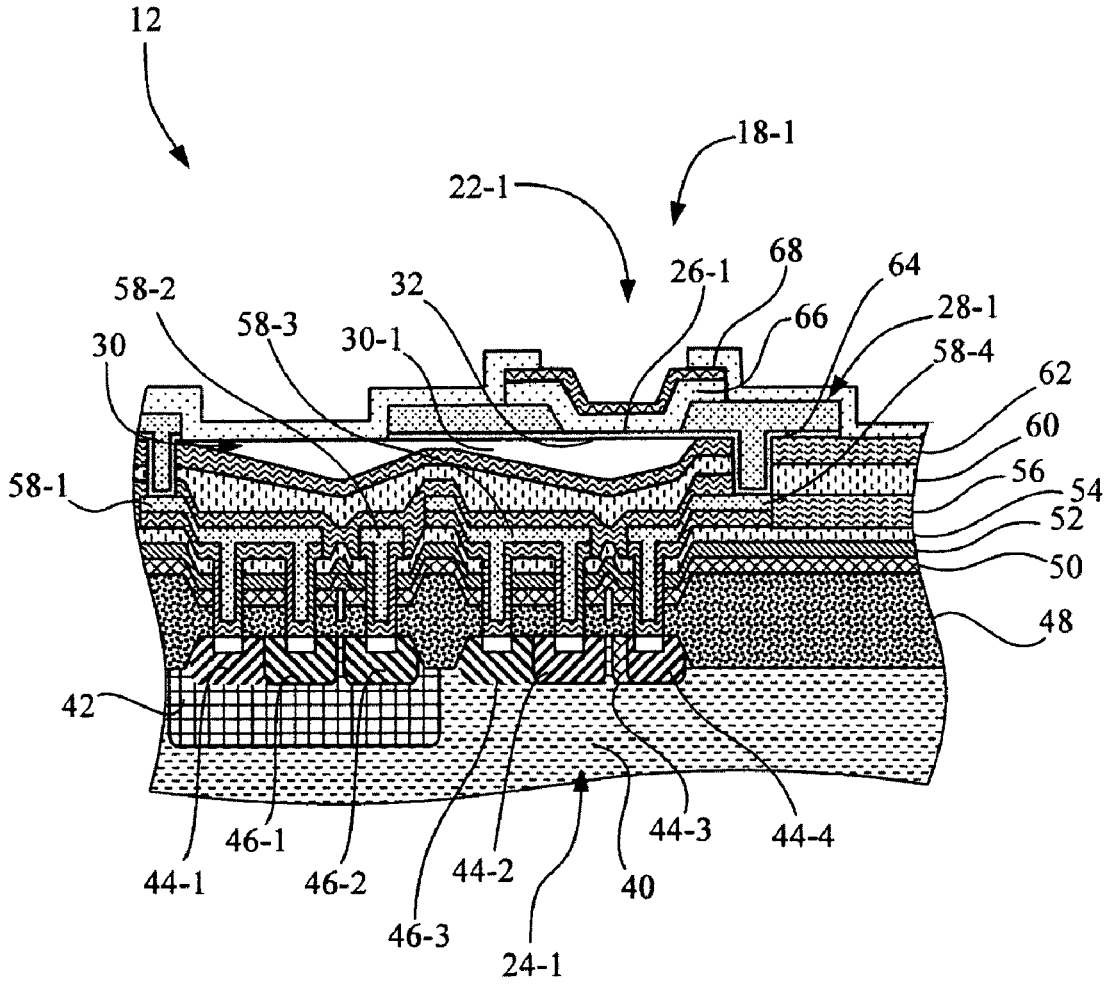
FIG. 4 is more detailed schematic cross section of a portion of the silicon chip of the ink ejection device of FIG. 1.
Figure 5:
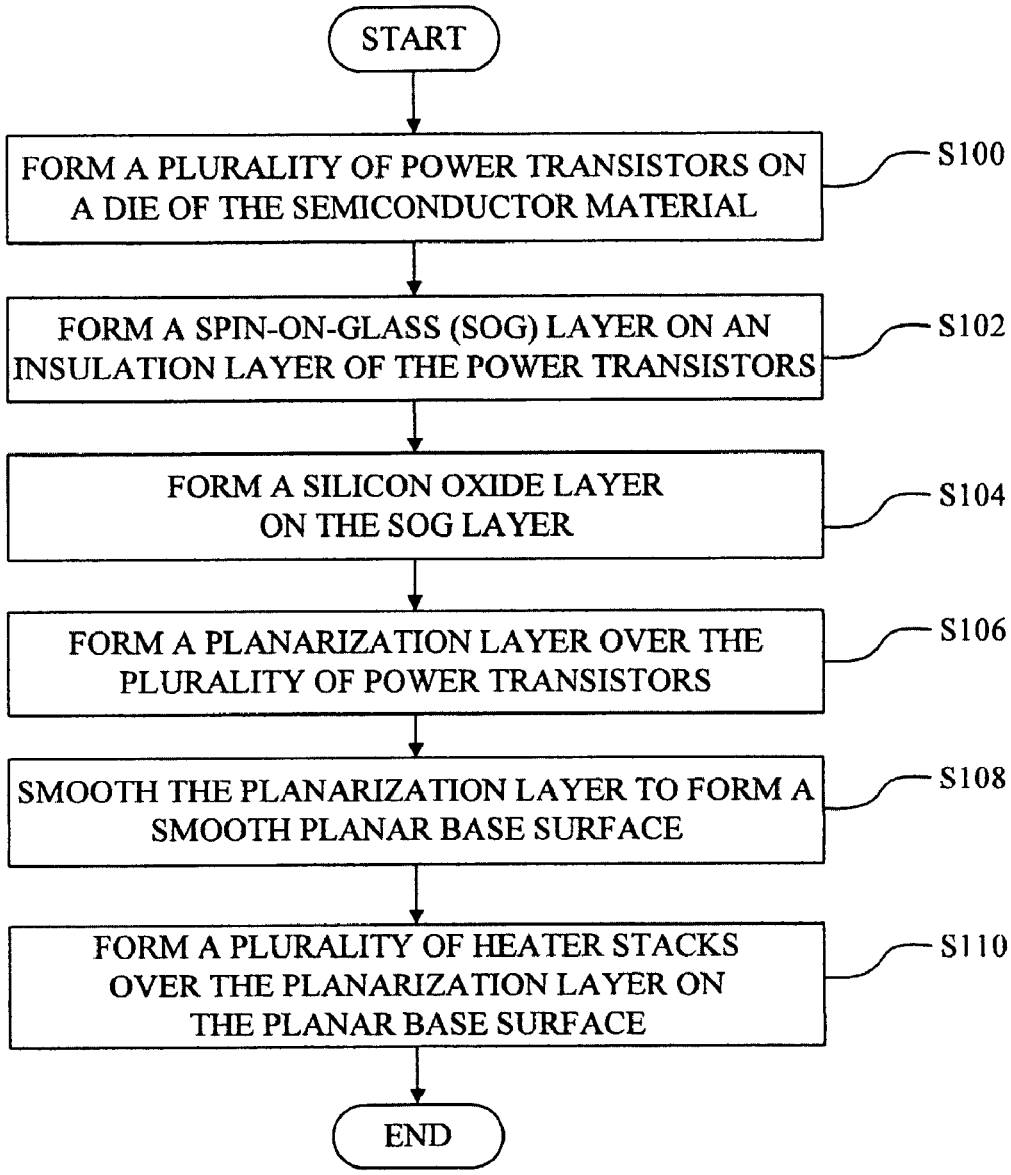
FIG. 5 is a flowchart of a method for fabricating the silicon chip of FIGS. 2-4 in accordance with an embodiment of the present invention.

Referring to FIG. 4, there is shown a more detailed schematic cross section of a portion of silicon chip 12, configured in accordance with an embodiment of the present invention. A method for fabricating silicon chip 12 in accordance with an embodiment of the present invention will be described with respect to the flowchart of FIG. 5.

At act S100, the process forms a plurality of power transistors 24 on a die 38 of semiconductor material. Referring to FIG. 4, power transistor 24-1 is formed from a stack of semiconductor material layers. For example, power transistor may include a P-material base 40 that has been doped to form an N well 42; N+ regions 44-1, 44-2, 44-3 and 444; and P+ regions 46-1, 46-2, 46-3. Formed over the base 40 are various insulation layers 48, 50, 52, 54 and 56, which may be formed, for example, from silicon oxide. Metallic conductors 58-1, 58-2, 58-3, 58-4, etc, (e.g., aluminum) are formed to extend through the various insulation layers, and are variously electrically connected to N+ regions 44-1, 44-2, 44-3 and 44-4; and P+ regions 46-1, 46-2, 46-3.

At act S102, a spin-on-glass (SOG) layer 60 is formed on insulation layer 56 of the power transistors, e.g., power transistor 24-1 as shown in FIG. 4.

At act S104, formed on SOG layer 60 is a silicon oxide layer 62.

At act S106, a planarization layer 30 is formed over the plurality of power transistors 24. More particularly, for example, planarization layer 30 (e.g., the planarization layer portion 30-1 as shown in FIG. 4) is formed on silicon oxide layer 62.

At act S108, planarization layer 30 is smoothed, e.g., etched or polished, to form smooth planar base surface 32. Polishing may be performed, for example, using chemical mechanical polish (CMP) techniques. The forming of smooth planar base surface 32 is highly desired, since the flatness correlates to improved control over the tapering of surfaces in the heater stacks 22, as well as uniform heating by the heater stacks 22.

At act S110, the plurality of heater stacks 22 are formed over the planarization layer 30 on planar base surface 32, with each heater stack of the plurality of heater stacks 22 being positioned directly over, i.e., above, and electrically connected to a respective power transistor of the plurality of power transistors 24. Here, the term "directly over" means that a majority (e.g., 70 percent or more) of an area of a heater stack structure taken parallel to the X, Z plane is positioned above (i.e., in the Y-dimension) an area of an associated power transistor structure taken parallel to the X, Z plane, and with the heater stack being separated from the associated power transistor in the Y-axis dimension.

Heater stacks 22 are positioned such that a respective Y-plane passes through respective power transistor/heater stack pairs. For example, referring to FIG. 4, a heater stack 22-1, including electrical heater element 26-1, is formed over planarization layer portion 30-1, and positioned such that a Y plane, e.g., the Y-plane passing through line 2-2, passes through both electrical heater stack 22-1, including electrical heater element 26-1, and power transistor 24-1. In the present embodiment, each heater stack, e.g., heater stack 22-1, 22-2, etc., is formed from a metal layer 64, a silicon nitride layer 66, and a tantalum layer 68. As shown in FIG. 4, an electrical connection is made between electrical heater element 26-1 of heater stack 22-1 and power transistor 24-1 by way of conductor structure 28-1, i.e., metallic conductor 584 and metal layer 64.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A semiconductor chip having a plurality of ink jetting structures, each ink jetting structure of said plurality of ink jetting structures comprising:

a heater stack having an electrical heater element;

an ink ejection chamber above said electrical heater element;

a power transistor electrically connected to said electrical heater element; and a planarization layer interposed between said power transistor and said heater stack, said planarization layer having a planar base surface on which said heater stack is formed;

wherein said heater stack and said ink ejection chamber are formed directly above said power transistor over said planarization layer.

2. The semiconductor chip of claim 1, wherein a major elongation of said semiconductor chip lies along an X, Z-plane, and a Y-plane perpendicularly intersects said X, Z-plane along a thickness of said silicon chip, said Y-plane also intersecting said electrical heater element of said heater stack, said ink ejection chamber and said power transistor.

3. The semiconductor chip of claim 1, wherein said planarization layer is formed over said power transistor.

4. The semiconductor chip of claim 1, wherein said planarization layer is formed from a low K dielectric material.

5. The semiconductor chip of claim 4, wherein said low K dielectric material is aerogel.

6. The semiconductor chip of claim 1, wherein said planarization layer is formed on a dielectric material.

7. The semiconductor chip of claim 1, wherein said planarization layer is formed from one of a spin-on-glass (SOG) material and silicon oxide.

8. An ink ejection device, comprising:

a nozzle plate having a plurality of nozzle holes; and a semiconductor chip having a plurality of ink jetting structures respectively associated with said plurality of nozzle holes, each ink jetting structure of said plurality of ink jetting structures including:

a heater stack having an electrical heater element;

an ink ejection chamber above said electrical heater element, said ink ejection chamber associated with one of said plurality of nozzle holes;

a power transistor electrically connected to said electrical heater element; and a planarization layer interposed between said power transistor and said heater stack, said planarization layer having a planar base surface on which said heater stack is formed;

wherein said heater stack, said ink ejection chamber, and said one of said plurality of nozzle holes are formed directly above said power transistor over said planarization layer.

9. The ink ejection device of claim 8, wherein a major elongation of said semiconductor chip lies along an X, Z plane, and a Y-plane perpendicularly intersects said X, Z plane along a thickness of said silicon chip, said Y-plane also intersecting said electrical heater element of said heater stack, said ink ejection chamber, said one of said plurality of nozzle holes and said power transistor.

10. The ink ejection device of claim 8, wherein said planarization layer is formed over said power transistor.

11. The ink ejection device of claim 8, wherein said planarization layer is formed from a low K dielectric material.

12. The ink ejection device of claim 11, wherein said low K dielectric material is aerogel.

13. The ink ejection device of claim 8, wherein said planarization layer is formed on a dielectric material.

14. The ink ejection device of claim 8, wherein said planarization layer is formed from one of a spin-on-glass (SOG) material and silicon oxide.

* * * * *